US010876526B2

(12) United States Patent
Graf et al.

(10) Patent No.: US 10,876,526 B2
(45) Date of Patent: Dec. 29, 2020

(54) METHOD AND DEVICE FOR OPERATING A SPEED-CONTROLLED FLUID PUMP

(71) Applicant: Continental Automotive GmbH, Hannover (DE)

(72) Inventors: Rolf Graf, Glashuetten (DE); Heiko Jausel, Rosbach (DE)

(73) Assignee: Vitesco Technologies GmbH, Hannover (DE)

( * ) Notice: Subject to any disclaimer, the term of this patent is extended or adjusted under 35 U.S.C. 154(b) by 501 days.

(21) Appl. No.: 15/523,580

(22) PCT Filed: Nov. 2, 2015

(86) PCT No.: PCT/EP2015/075463
§ 371 (c)(1),
(2) Date: May 1, 2017

(87) PCT Pub. No.: WO2016/071277
PCT Pub. Date: May 12, 2016

(65) Prior Publication Data

US 2017/0314548 A1 Nov. 2, 2017

(30) Foreign Application Priority Data

Nov. 3, 2014 (DE) ..... 10 2014 222 398

(51) Int. Cl.
*F04B 49/08* (2006.01)
*F02D 41/30* (2006.01)
(Continued)

(52) U.S. Cl.
CPC ..... *F04B 49/08* (2013.01); *F02D 41/3082* (2013.01); *F02M 37/08* (2013.01);
(Continued)

(58) Field of Classification Search
CPC ..... F04B 17/03; F04B 23/02–028; F04B 49/06–065; F04B 49/08–10;
(Continued)

(56) References Cited

U.S. PATENT DOCUMENTS

2008/0066990 A1 3/2008 Wong et al.
2009/0241954 A1 10/2009 Karlsson
2012/0245819 A1* 9/2012 Graf ..... F02D 41/221 701/99

FOREIGN PATENT DOCUMENTS

EP 0 731 013 A2 9/1996
FR 2761329 * 3/1997
FR 2 761 329 A1 10/1998

* cited by examiner

*Primary Examiner* — Alexander B Comley
(74) *Attorney, Agent, or Firm* — Cozen O'Connor

(57) ABSTRACT

A method for operating a speed-controlled fluid pump includes: providing an electrical control current for the fluid pump; providing a maximum value for the electrical control current, which maximum value corresponds to a maximum permissible pressure at an outlet side of the fluid pump; providing a threshold value for the control current, the threshold value corresponding to a further maximum permissible pressure at the outlet side of the fluid pump and is predefined in dependence upon at least one boundary condition, the threshold value being less than the maximum value for the electrical control current; and controlling the fluid pump with not more than the threshold value for the control current, if it has been determined that the at least one boundary condition holds, so as to limit the pressure at the outlet side of the fluid pump to a value provided for the at least one boundary condition.

8 Claims, 1 Drawing Sheet

(51) Int. Cl.

| | |
|---|---|
| ***F02M 37/08*** | (2006.01) |
| ***F04B 49/06*** | (2006.01) |
| ***F02D 41/20*** | (2006.01) |
| ***F02D 33/00*** | (2006.01) |

(52) U.S. Cl.
CPC ..... *F04B 49/065* (2013.01); *F02D 33/003* (2013.01); *F02D 2041/2058* (2013.01); *F02D 2200/0604* (2013.01); *F04B 49/06* (2013.01); *F04B 2203/0201* (2013.01); *F04B 2205/05* (2013.01); *F04B 2207/03* (2013.01)

(58) Field of Classification Search
CPC ..... F04B 49/20; F04B 2203/0201; F04B 2203/0212; F04B 2203/0208; F04B 2205/04–05; F04B 2207/03; F04D 15/0066; F04D 15/0077; F02D 41/3082; F02D 2041/2048; F02D 2041/2058; F02M 37/08; F02M 2037/085
USPC ..... 123/497; 417/44.11, 45
See application file for complete search history.

METHOD AND DEVICE FOR OPERATING A SPEED-CONTROLLED FLUID PUMP

CROSS-REFERENCE TO RELATED APPLICATIONS

This is a U.S. national stage of application No. PCT/EP2015/075463, filed on 2 Nov. 2015, which claims priority to the German Application No. 10 2014 222 398.9 filed 3 Nov. 2014, the content of both incorporated herein by reference.

BACKGROUND OF THE INVENTION

1. Field of the Invention

The invention relates to a method and a device for operating a rotational-speed-regulated fluid pump, in particular a fuel pump for a motor vehicle.

2. Related Art

In motor vehicles, a sensor for determining a fluid pressure, in particular a sensor for the fuel pressure, can be dispensed with for reasons of cost. For the motor controller there is therefore no direct possibility, by a measurement of the fuel pressure and of the set values to the electronic pump controller, to deduce the state of the fuel supply system and, if appropriate, to limit an overpressure by suitable measures.

Local monitoring of the fuel system, for example by the control electronics of the fuel pump, can address these problems. Here, for example, the pump current and the instantaneous rotational speed of the pump are monitored and then, if appropriate, the pressure is limited by regulating the pump current via the rotational speed. Conventionally, a single maximum pressure that should not be exceeded is stored for this purpose.

SUMMARY OF THE INVENTION

An object of the invention is to specify a method and a device for operating a rotational-speed-regulated fluid pump, which method or device allows reliable operation of the fluid pump, even in the case of differing ambient conditions.

According to one aspect, the invention is characterized by a method for operating a rotational-speed-regulated fluid pump and a corresponding device that is suitable for executing the method.

An electrical control current for the fluid pump is provided, A maximum value for the control current is provided which value corresponds to a maximum permissible pressure at the outlet side of the fluid pump. A threshold value for the control current is provided, which value corresponds to a further maximum permissible pressure at the outlet side of the fluid pump and is predefined in dependence on at least one boundary condition. The threshold value is less than the maximum value. The fluid pump is controlled with not more than the threshold value of the control current, if it has been determined that the boundary condition holds, in order to limit the pressure at the outlet side of the fluid pump to a value provided for the boundary condition.

Due to the provision of the maximum value and also the threshold value; two maximum permissible pressures that differ from one another are defined. In this case, the maximum value concerns the absolutely highest permissible pressure for the system in which the rotational-speed-regulated fluid pump is arranged. The maximum value for the control current is used as a limit parameter, in order, if appropriate, to limit the system pressure in extreme cases to the maximum permissible pressure. Consequently, it is, for example, possible to dispense with a mechanical overpressure valve for system protection.

For certain operating conditions, which arise when the boundary conditions hold, the threshold value makes it possible to provide further limitations in addition to the limitation to the maximum value. The threshold value is predefined in dependence on the boundary condition or a plurality of boundary conditions and provides a further current limitation, in order to limit the system pressure in dependence on the boundary conditions or the operating conditions to a further maximum pressure. The pressure that is predefined by the threshold value is less than or equal to the pressure that is predefined by the maximum value. According to further embodiments, the pressure that is predefined by the threshold value is less than the pressure that is predefined by the maximum value.

Consequently, a pressure limitation to pressures below the maximum permissible pressure resulting from the maximum value is possible. A pressure limitation to pressures within the normal working range is possible. In this case, various boundary conditions are taken into consideration. It is possible to replace a conventionally provided overpressure valve with an intelligent characteristic-map evaluation. A local pressure limitation without a pressure sensor is possible. A characteristic-map-supported pressure limitation in the subsystem of fluid pump and pump electronics is realized.

The fluid pump is in particular a fluid pump for a motor vehicle. The fluid pump is, for example, a fuel pump of a fuel delivery system of a motor vehicle.

According to further embodiments, the provision of the threshold value comprises controlling the fluid pump with the maximum value of the control current. A minimum pressure at the outlet side of the fluid pump is subsequently determined in dependence on a current consumption of the fluid pump after a predefined time period has elapsed. For example, the time period begins at the starting time of the fluid pump. A working pressure at the outlet side of the fluid pump is determined in dependence on the current consumption of the fluid pump after a further predefined time period has elapsed. The threshold value of the control current is provided in dependence on the determined working pressure. For example, the threshold value is set to the determined working pressure. The control current is limited to the determined threshold value. The working pressure is thereby limited. Alternatively, the threshold value is set to a value which is calculated from the working pressure. For example, the threshold value is set to a value which is 10% greater than or less than the determined working pressure. According to further embodiments, the threshold value is predefined once for the system and stored, for example, in a memory.

According to embodiments, the boundary condition comprises at least one of the following: A predefined pattern of a profile of set values of the control current; a time lapse; a temporal sequence of signals; an ambient value. The ambient value is in particular an ambient temperature, which is determined, for example, at the board of the pump controller.

In particular in the case of very low temperatures and during the initial start of the system following an extensive downtime, the fluid temperature corresponds to the temperature that is determined via the sensor at the controller. The viscosity of the fuel is dependent on the temperature. The viscosity of the fuel also influences the current consumption of the fuel pump. In particular in the case of flow pumps, the current consumption is significantly influenced by increasing rotational speeds. Here, the values can lead to differences in the pump current consumption of approximately 5 to 8% for low rotational speeds and 8 to 18% for relatively high rotational speeds. In some cases, even differences of approximately 50% are obtained. By taking the ambient temperature into consideration, the limitation of the fuel pressure via the limitation of the pump current is more accurate. Alternatively or additionally, a possible gelling of diesel fuel is determined by the temperature evaluation. For example, the pump rotational speed is then briefly limited and/or a warning is transmitted to the motor controller, so that the controller then adapts its behavior and the set value to the fuel pump.

According to further embodiments, the fluid pump is controlled with not more than the maximum value after the fluid pump has been controlled with not more than the threshold value of the control current, if a set value for the control current changes by a predefined value. As soon as the set value changes by the predefined value, for example decreases or increases by 5%, the limitation to the threshold value is dropped and a control with not more than the maximum value is permitted.

According to further embodiments, the control of the fluid pump with not more than the threshold value is performed in a temporally limited manner within a predefined time period. For example, the threshold value is set as the highest value for the predefined time period, beginning at the starting time of the fluid pump. Subsequently, the maximum value is permitted as the highest value and the limitation to the threshold value is endered inactive.

Alternatively or additionally, the control of the fluid pump with not more than the threshold value of the control current is performed only within a predefined temperature range. For example, the limitation of the control current to the threshold value is applied only at low temperatures. At temperatures above the predefined temperature range or below the predefined temperature range, there is only a limitation to the maximum value.

Alternatively or additionally, the control of the fluid pump with not more than the threshold value of the control current is performed only at predefined set values of the control current. The holding of the boundary condition is checked and if appropriate the control current is limited to the threshold value only in certain ranges for the control current, which current is predefined for example by a motor controller or the pump electronics in dependence on a pressure requirement.

BRIEF DESCRIPTION OF THE DRAWINGS

Further advantages, features and refinements emerge from the following examples described in connection with the figures, in which.

DETAILED DESCRIPTION OF THE PRESENTLY PREFERRED EMBODIMENTS

Figure 1:
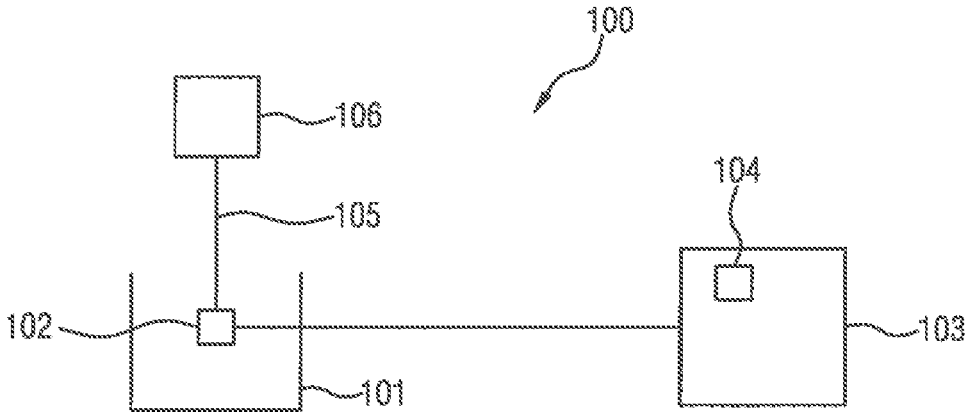
FIG. 1 shows a schematic illustration of a system according to exemplary embodiments.

FIG. 1 shows a system 100, which is, in particular, part of a fluid delivery system of a motor vehicle. In particular, the system 100 is part of a fuel delivery system for diesel or gasoline for a combustion engine of the motor vehicle. The system 100 has a tank 101, to store the fuel. A fluid pump 102 is provided. The fluid pump 102 is a fuel pump in the exemplary embodiment. The fuel pump 102 is provided to deliver the fuel from the tank 101. In particular, the fuel pump 102 is a so-called predelivery pump, which is able to provide pressures of up to 8 bar at an outlet side 105 of the fuel pump 102. The fuel pump 102 delivers the fuel, for example, to a further pump 106, which applies higher pressures to the fuel, for example up to 500 bar in the case of gasoline and up to 3000 bar in the case of diesel.

The fuel pump 102 is electrically connected to a device 103. The device 103 is set up to control or to regulate the fuel pump 102. In particular, the fuel pump 102 is a rotational-speed-regulated pump. The device 103 is, for example, part of a pump controller. The fuel pump 102 is thus locally regulated and consequently the motor controller can be relieved of the pressure-limitation function. According to further exemplary embodiments, the device 103 is part of the motor controller or is distributed over several controllers.

The device 103 has a temperature sensor 104 for determining the ambient temperature. The temperature sensor 104 is, for example, provided on a conductor plate of the device 103. The temperature can thus be evaluated in a simple manner and without additional costs because of an additional sensor.

Figure 2:
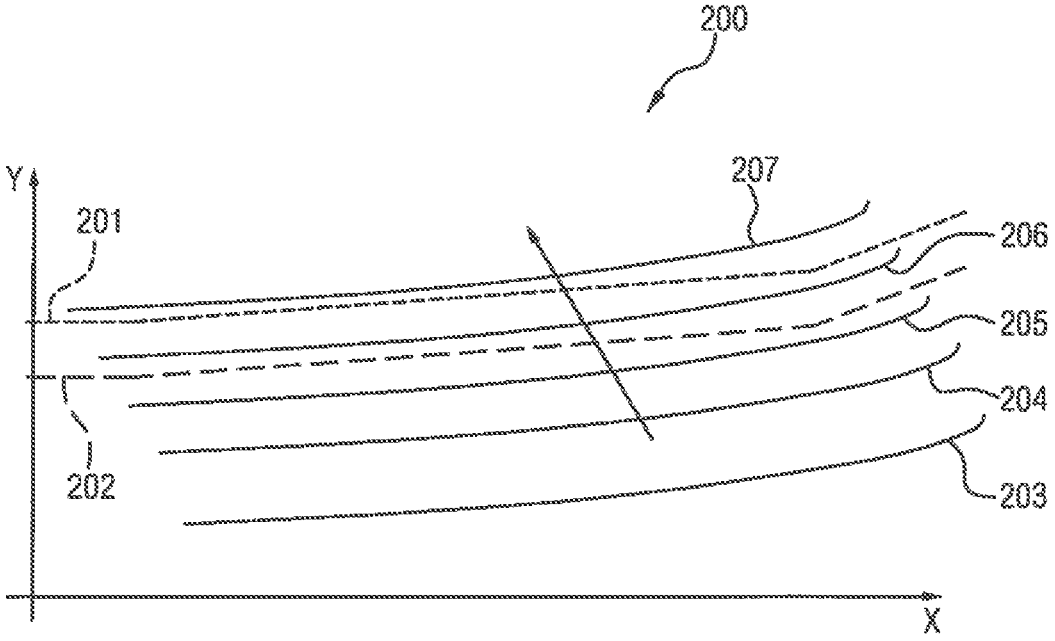
FIG. 2 shows a schematic illustration of a current/rotational-speed diagram according to exemplary embodiments.

FIG. 2 shows a current/rotational-speed diagram of the fuel pump 102. The rotational speed of the fuel pump 102 is plotted on the X-axis. The current consumption of the fuel pump 102 is plotted on the Y-axis. In the case of pumps with brush-type motors, according to exemplary embodiments, the parameter "rotational speed" of the X-axis can be replaced by the parameter "pump voltage", in particular if no rotational speed is determined via the commutator current ripple. The arrow indicates an increasing system pressure. According to exemplary embodiments, the current consumption of the fuel pump 102 corresponds to the system pressure. A maximum value 201 for the control pressure is predefined. The maximum value 201 for the control current corresponds to a maximum permissible pressure for the system 100, in particular at the outlet side 105. If the pump current and the rotational speed of the fuel pump 102 are monitored, it is possible to limit the actual pressure in the system 100 by regulating the pump current via the rotational speed. In particular, the pressure is limited to the limit pressure, which corresponds to the maximum value 201 for the control current.

Here, it is unimportant whether a system with electronically commutated pumps or classically mechanically commutated pumps is involved, in which the rotational speed can be determined via the current ripple. Typically, electronically commutated pumps are used.

The phase current or the current consumption of the fluid pump 102 increases with increasing pressure of the fuel. In the case of the rotational-speed-regulated fuel pump 102, there is, for the rotational speed, a good relationship between the instantaneous pump current and the pressure in the system 100. This relationship is illustrated by the system pressures 203, 204, 205, 206 and 207. The system pressures 203, 204, 205, 206 and 207 are stored, for example, in a characteristic map 200. The rotational speed of the fluid pump 102 is known in the device 103, since regulation according to this rotational speed is carried out in particular. By further processing and linking the information concerning the instantaneous phase current or the current consumption that exists in the system 100, the system pressure can be determined.

The maximum value 201 is used as a limit parameter in the system 100, in order to limit the system pressure in an extreme case to values above the normal working pressures. Although the system pressure can increase above the normal working pressures, it is upwardly limited to a value that is predefined by the maximum value 201 for the control current. Consequently, it is, for example, possible to dispense with a mechanical overpressure valve for system protection.

For certain operating conditions, at least one further threshold value 202 is predefined, in particular in the case of small systems. According to further embodiments, two or more threshold values 202 are predefined. The threshold value 202 or the threshold values 202 are dependent on various boundary conditions. The threshold value 202 for the control current lies below the maximum value 201 for the control current. The threshold value 202, however, in particular also still lies within the working range.

The threshold value 202 corresponds to a current limitation of the fuel pump 102 dependent on one or several boundary conditions. The boundary conditions are in particular one or several of the following: a pattern of the set value, a time lapse, a temporal sequence of signals, ambient values. The ambient values correspond in particular to an ambient temperature of the electronics which, for example, has been determined by the temperature sensor 104.

A typical sequence of the method is given by way of example below. First of all, the fuel pump 102 is stationary, in particular corresponding to a set value of the motor controller.

A request to the fuel pump 102 is detected according to a certain delivery power. In particular, a request is detected according to a maximum delivery power. The fuel pump 102 is started with the maximum possible control current. A predefined time period after the start, a minimum pressure is detected based on the current consumption of the fuel pump 102. The time period is, for example, 0.2 seconds after the start. The minimum pressure is, for example, 2 bar. After a further time period, a nominal working pressure is detected based on the current consumption of the fuel pump 102. The further time period is, for example 0.3 seconds after the start. The nominal working pressure is, for example, an average working pressure. The nominal (average) working pressure is, for example, between 4 and 5 bar. The control current is limited to the determined working pressure. According to further embodiments, the control current is limited to a value derived from the determined working pressure, for example 10% greater than or less than the determined working pressure. According to further exemplary embodiments, the threshold value 202 is fixedly predefined. In particular, the threshold value 202 does not match the maximum value 201 for the extreme overpressure limitation. The set signal, which comprises set values for the control current, is monitored. The limitation of the control current or of the current consumption of the fuel pump 102 to the threshold value 202 is dropped, as soon as the set value changes by a certain amount, for example a reduction or an increase by 5%. The limitation of the control current or of the current consumption of the fuel pump 102 to the threshold value 202 is rendered inactive, in particular after a predefined time period has elapsed. The limitation to the threshold value 202 is rendered inactive after a certain duration following the start. It only becomes active again if, for a minimum time, for example 0.3 seconds, a set value is again detected that corresponds to a stationary fuel pump 102.

Additionally, according to further exemplary embodiments, a temperature-dependent component is used. It is thereby possible to apply the current or pressure limitation only at low temperatures or to adapt the threshold value 202 in dependence on the ambient temperature. In particular during an initial start of the fuel pump 102 under very cold conditions, for example a cold start after severe frost, the electronics temperature at the fuel sensor 104 is very similar to the fuel temperature.

The evaluation of the temperature allows the viscosity of the fuel to be taken into consideration. The viscosity of the fuel also influences the current consumption of the fuel pump 102. In particular in the case of flow pumps, the current consumption is significantly influenced by increasing rotational speeds. Here, the values for common fuels can lead to differences in the pump current consumption of approximately 5 to 8% for low rotational speeds and 8 to 18% for relatively high rotational speeds. In some cases, even differences of approximately 50% are obtained. By taking the temperature into consideration, the dependence of the viscosity of the medium in the limitation of the fuel pressure via the limitation of the control current to the threshold value 202 is taken into consideration. The limitation of the fuel pressure via the limitation of the control current is thus more accurate.

The device 103 or the method allows a conventionally provided overpressure valve to be replaced with an intelligent evaluation of the characteristic map 200. A local pressure limitation at the outlet side of the fuel pump 102 is realized without a pressure sensor. In the subsystem of fuel pump 102 and pump electronics, a characteristic-map-supported pressure limitation is possible. A pressure limitation to pressures within the normal working range of the fuel pump 102 is possible. Additionally, a pressure limitation to pressures below the normal overpressure limit is realized, that is to say below the maximum value 201. The pressure limitation occurs with a wide variety of boundary conditions taken into consideration, for example temperature, signal profile of the set signal, time lapse or a combination of boundary conditions. A temporally limited activation of the limitation to pressures within the working range below the threshold value 202 is possible. Alternatively or additionally, a temperature-dependent limited activation of the limitation to pressures within the normal working range below the threshold value 202 is possible. Alternatively or additionally, an activation, limited by the set signal, of the limitation to pressures within the working range below the threshold value 202 is possible. The pressure limitation within the normal working range below the threshold value 202 is ended, for example, in dependence on special thresholds of the set value, time lapse, temperature or a combination of the variables. The method is, for example, executed solely in the fuel pump electronics. Alternatively, the method is, for example, executed in a distributed, manner in the entire system or solely in the motor controller. By the method, the influence of the viscosity of the motor vehicle is minimized and the accuracy of the pressure limitation therefore increased. Alternatively or additionally, the influences of the temperature on the viscosity of the motor vehicle and, indirectly, on the pressure limitation are minimized and, as a result, the accuracy of the pressure limitation increased. Also it is possible to reduce the system costs for the system 100 in comparison with conventional systems since, in particular, a pressure sensor and/or an overpressure valve can be dispensed with.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A method for operating a rotational-speed-regulated fluid pump (102), the method comprising:

providing an electrical control current for the fluid pump (102);

providing a maximum value (201) for the electrical control current, the maximum value corresponding to a maximum permissible pressure at an outlet side of the fluid pump (102);

providing a threshold value (202) for the electrical control current, the threshold value corresponding to a maximum working pressure at the outlet side of the fluid pump (102) and being predefined in dependence upon at least one boundary condition, wherein the maximum working pressure corresponding to the threshold value (202) is less than the maximum permissible pressure corresponding to the maximum value (201) for the electrical control current; and controlling the fluid pump (102) with not more than the threshold value (202) for the control current, in a case in which it has been determined that the at least one boundary condition holds, so as to limit the pressure at the outlet side of the fluid pump (102) to a value provided for the at least one boundary condition, wherein the providing of the threshold value (202) comprises:

determining a working pressure at the outlet side of the fluid pump (102) in dependence on a current consumption of the fluid pump (102) after a predefined time period, beginning at a starting time of the fluid pump, has elapsed; and providing the threshold value (202) in dependence on the determined working pressure.

2. The method as claimed in claim 1, wherein the at least one boundary condition comprises at least one selected from the group of:

a predefined pattern of a profile of set values of the control current, a time lapse, a temporal sequence of signals, and an ambient temperature.

3. The method as claimed in claim 1, wherein the fluid pump (102) is controlled with not more than the maximum value (201) for the electrical control current after the fluid pump (102) has been controlled with not more than the threshold value (202) of the control current, in a case in which a set value for the control current changes by a predefined value.

4. The method as claimed in claim 1, wherein the controlling of the fluid pump (102) with not more than the threshold value (202) of the control current is performed in a temporally limited manner within a predefined time period.

5. The method as claimed in claim 1, wherein the controlling of the fluid pump (102) with not more than the threshold value (202) of the control current is performed only within a predefined temperature range.

6. The method as claimed in claim 1, wherein the controlling of the fluid pump (102) with not more than the threshold value (202) of the control current is performed only at predefined set values of the control current.

7. A device for operating a rotational-speed-regulated fluid pump, wherein the device is configured to execute the method as claimed in claim 1.

8. A method for operating a rotational-speed-regulated fluid pump (102), the method comprising:

providing an electrical control current for the fluid pump (102);

providing a maximum value (201) for the electrical control current, the maximum value corresponding to a maximum permissible pressure at an outlet side of the fluid pump (102);

providing a threshold value (202) for the electrical control current, the threshold value corresponding to a maximum working pressure at the outlet side of the fluid pump (102) and being predefined in dependence upon at least one boundary condition, wherein the maximum working pressure corresponding to the threshold value (202) is less than the maximum permissible pressure corresponding to the maximum value (201) for the electrical control current; and controlling the fluid pump (102) with not more than the threshold value (202) for the control current, in a case in which it has been determined that the at least one boundary condition holds, so as to limit the pressure at the outlet side of the fluid pump (102) to a value provided for the at least one boundary condition, wherein the providing of the threshold value (202) comprises:

controlling the fluid pump (102) with the maximum value (201) for the electrical control current;

determining a minimum pressure at the outlet side of the fluid pump (102) in dependence on a current consumption of the fluid pump (102) after a predefined time period has elapsed;

determining a working pressure at the outlet side of the fluid pump (102) in dependence on the current consumption of the fluid pump (102) after a further predefined time period has elapsed; and providing the threshold value (202) in dependence on the determined working pressure.

* * * * *